US008753482B2

(12) United States Patent
Byrd

(10) Patent No.: US 8,753,482 B2
(45) Date of Patent: Jun. 17, 2014

(54) METHOD AND APPARATUS FOR TREATMENT OF PAPER STOCK

(75) Inventor: Christopher Thomas Byrd, Clarkston, MI (US)

(73) Assignee: Honeywell International Inc., Morristown, NJ (US)

( * ) Notice: Subject to any disclaimer, the term of this patent is extended or adjusted under 35 U.S.C. 154(b) by 1176 days.

(21) Appl. No.: 12/112,185

(22) Filed: Apr. 30, 2008

(65) Prior Publication Data

US 2009/0272508 A1 Nov. 5, 2009

(51) Int. Cl.
*D21F 7/06* (2006.01)
*D21F 1/08* (2006.01)
*D21F 1/00* (2006.01)

(52) U.S. Cl.
CPC .. *D21F 1/08* (2013.01); *D21F 1/00* (2013.01); *D21F 7/06* (2013.01)
USPC ..... 162/192; 162/263; 162/381

(58) Field of Classification Search
CPC ..... D21F 1/00; D21F 1/08; D21F 7/06
USPC ..... 162/192, 381, 263
See application file for complete search history.

(56) References Cited

U.S. PATENT DOCUMENTS

| | | | | |
|---|---|---|---|---|
| 2,699,709 | A * | 1/1955 | Ernst et al. | 162/209 |
| 4,948,467 | A * | 8/1990 | Creagan | 162/358.3 |
| 2002/0127940 | A1 * | 9/2002 | Ruhrig | 442/381 |
| 2004/0140077 | A1 * | 7/2004 | Bricco et al. | 162/209 |
| 2004/0261965 | A1 * | 12/2004 | Burma | 162/198 |
| 2006/0196392 | A1 * | 9/2006 | Meisen et al. | 106/456 |
| 2007/0255446 | A1 | 11/2007 | Backstrom et al. | |

* cited by examiner

*Primary Examiner* — Jacob Thomas Minskey

(57) ABSTRACT

A sheet formation section of a paper machine includes a sensor that measures a first characteristic of a sheet of paper being formed. The sensor may measure a characteristic such as streaking, rises, depressions, or smoothness. The sheet formation section also includes an apparatus that applies a magnetic field to the sheet of paper being formed. The machine also includes a controller that causes the apparatus to apply the magnetic field in response to a signal from the sensor representative of the first characteristic. The magnetic field transforms a second characteristic of the sheet of paper. The apparatus may transform a characteristic such as water content or fiber orientation.

22 Claims, 2 Drawing Sheets

METHOD AND APPARATUS FOR TREATMENT OF PAPER STOCK

TECHNICAL FIELD

This disclosure relates generally to paper machines and more specifically to a method and apparatus for treating paper stock in a sheet formation section of a paper machine.

BACKGROUND

In a paper machine, a pulp suspension (or slurry) is passed into a head-box which extrudes it through a thin, horizontal slit across the full machine width on to a moving, endless wire mesh (or screen). A mixture of gravity and suction remove water in this "wire section" (or sheet formation section) of the paper machine so that the pulp fibers spread and consolidate to form a sheet on top of the wire mesh.

Subsequently, this sheet of wet paper is squeezed in a series of presses, where its water content is further reduced, and then routed around a series of heated drums where drying takes place. Throughout its passage from the headbox to the drying cylinders, various types of wire mesh or fabric belts support the paper web. After drying, some papers may undergo surface treatments, such as sizing or calendaring (smoothing). The finished paper is finally wound onto a reel.

SUMMARY

This disclosure provides a method and apparatus for treating paper stock in a sheet formation section of a paper machine.

In a first embodiment, a method includes applying a magnetic field to a sheet of paper being formed in a sheet formation section of a paper machine. The magnetic field transforms a physical characteristic of the sheet of paper. In particular embodiments, the physical characteristic transformed is water content or fiber orientation. In other particular embodiments, a plurality of magnetic fields are applied at a corresponding plurality of locations.

In a second embodiment, a sheet formation section of a paper machine includes an apparatus that applies a magnetic field to a sheet of paper being formed. The magnetic field transforms a physical characteristic of the sheet of paper.

In a third embodiment, a sheet formation section of a paper machine includes a sensor and an apparatus. The sensor measures a first characteristic of a sheet of paper being formed. The apparatus applies a magnetic field to the sheet of paper. The machine also includes a controller that causes the apparatus to apply the magnetic field in response to a signal from the sensor representative of the first characteristic. The magnetic field transforms a second characteristic of the sheet of paper.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
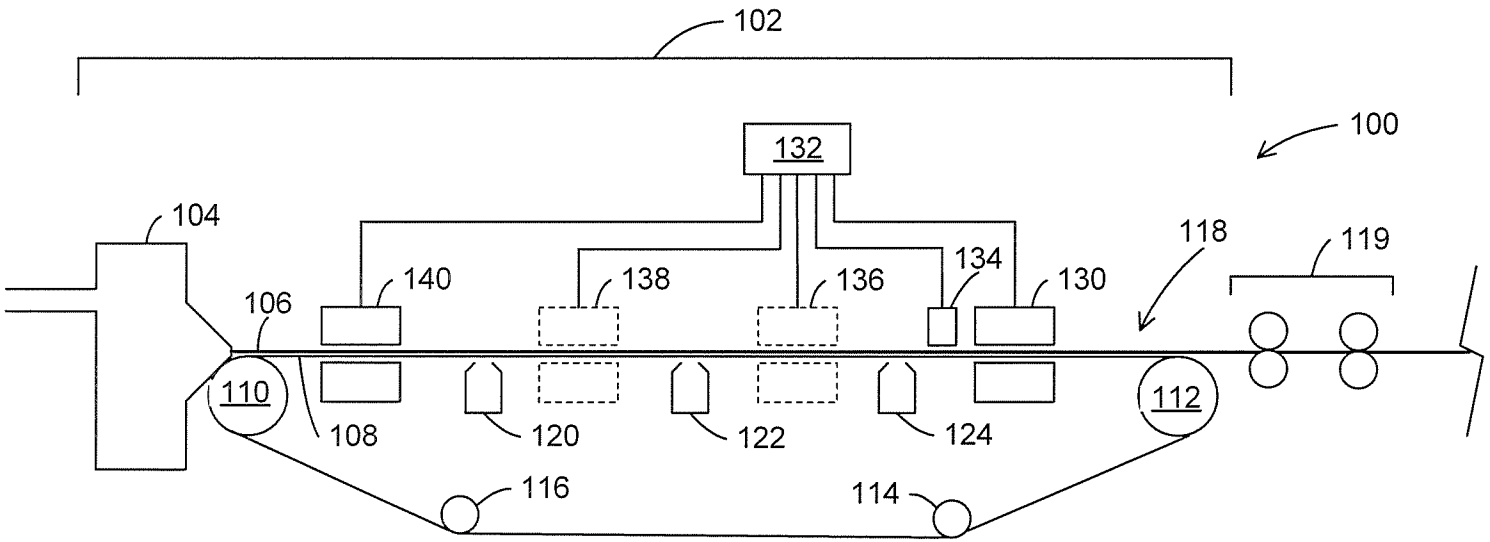
FIG. 1 presents a schematic side view of a portion of a paper machine according to this disclosure.
Figure 2:
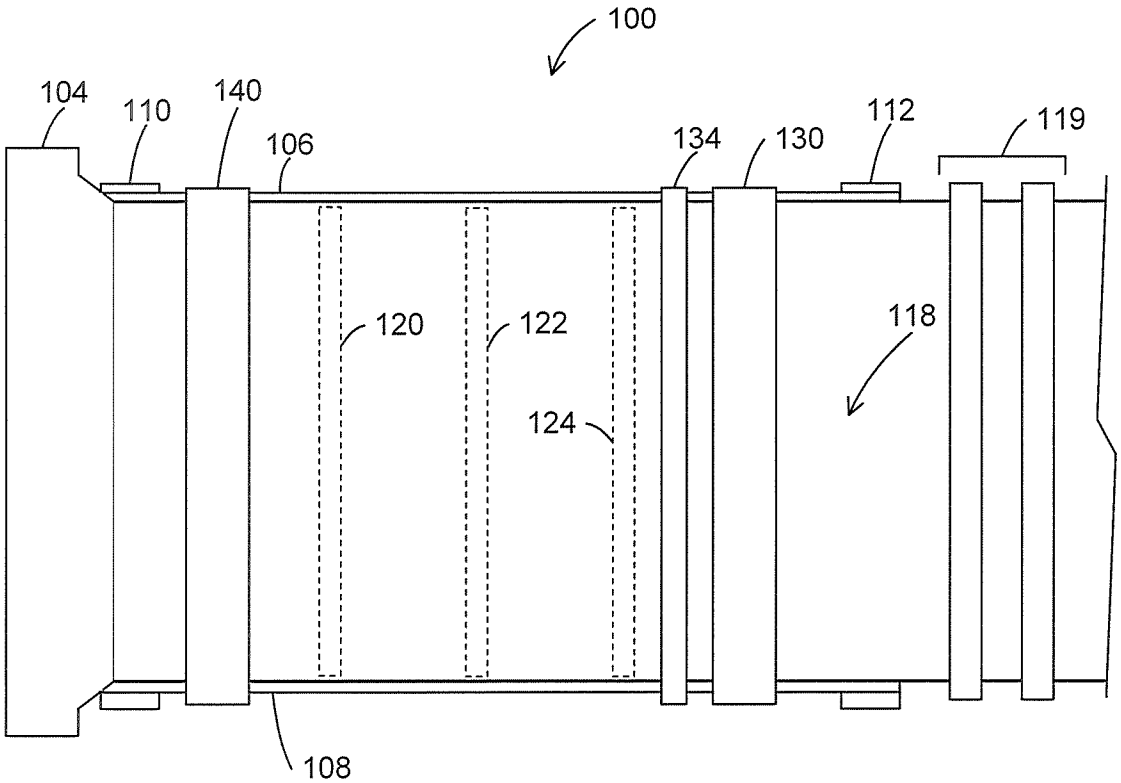
FIG. 2 presents a schematic top view of a portion of a paper machine according to this disclosure.

FIGS. 1 and 2, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

FIGS. 1 and 2 present schematic side and top views, respectively, of a portion of a paper machine 100 according to this disclosure. The paper machine 100 includes a sheet formation section 102. The sheet formation section 102 includes a headbox 104, which distributes a pulp suspension uniformly across the machine onto a continuous moving conveyor belt 108 of wire screen, wire mesh, felt, or other suitable material. The pulp suspension is an initial stage of a sheet of paper 106 that is formed in the sheet formation section 102. The belt 108 passes around a so-called 'breast roll' 110, moves towards a forward drive roll 112, passes around the forward drive roll 112 and over idler rolls 114 and 116 on its return to the breast roll 110.

As the pulp suspension passes through the sheet formation section 102 of the paper machine 100 water is progressively removed and the remaining pulp settles, forming a web, which is a next stage of the sheet of paper 106. A region 118 of the sheet formation section 102 is referred to as a 'dry line', where sufficient water has been removed and the pulp web is sufficiently cohesive for the sheet of paper 106 to be self-supporting as it passes through subsequent portions of the paper machine 100, such as press rollers 119. Typically, water is removed from the pulp suspension by gravity, the application of vacuum from suction boxes 120, 122 and 124, and other techniques.

In the paper machine 100 according to the present disclosure, the sheet of paper 106 is also treated by an electromagnet 130, which applies a magnetic field. The electromagnet 130 is positioned near the sheet of paper 106 at a location between the headbox 104 and the dry line 118, where a physical characteristic of the pulp may be transformed, prior to the pulp web becoming set at the dry line 118. The electromagnet 130 may comprise an apparatus on both sides of the sheet 106 (as shown) or on only the top side or the bottom side. The electromagnet 130 may be controlled by a controller 132 that may adjust the strength, polarity, duty cycle or other characteristic of the magnetic field generated by the electromagnet 130.

The electromagnet 130 will act only on materials in the paper suspension with an electric charge or a magnetic dipole. In an embodiment where the pulp or another component of the pulp suspension already has a magnetic dipole or electric charge, the electromagnet 130 may act on the sheet of paper 106 without further modification. A large static electric charge is often developed on the paper being processed in a paper machine, which charge may also enable the electromagnet 130 to act on the sheet 106.

In another embodiment, an electric field generator 140, or other suitable device, creates an electric field through which the pulp suspension of the sheet of paper 106 passes, inducing an electric charge on a component material of the pulp suspension. In yet another embodiment, a material with a magnetic dipole or electric charge, such as an ionic solution, is mixed with the pulp suspension before deposition on the belt 108 by the headbox 104.

In FIG. 1, optional electromagnets 136 and 138 are shown located at additional locations near the sheet of paper 106. In such an embodiment, magnetic fields are applied to the sheet 106 at a plurality of locations. The controller 132 also controls the electromagnets 136 and 138.

A sensor 134 is located adjacent to the sheet of paper 106 at a location where the sheet 106 is measured by the sensor 134 before passing through the electromagnet 130. The sensor 134 operates to measure a characteristic of the sheet 106 such as streaking, rises, depressions, smoothness, or other characteristics that an operator of the paper machine 100 may desire to control. The sensor 134 is coupled to the controller 132 so that the controller 132 receives a signal from the sensor 134 related to the measured characteristic of the sheet 106. In this way, the controller 132 operates to control the magnetic field applied by the electromagnet 130 to the sheet 106 in response to the characteristic measured by the sensor 134 in order to transform the measured (or a corresponding) characteristic of the sheet 106.

In other embodiments, the sensor 134 may be positioned at a location closer to the headbox 104 than the position shown in FIGS. 1 and 2. In still other embodiments, two or more sensors 134 may be provided, including a sensor 134 paired with each of the electromagnets 130, 136 and 138.

The electromagnet 130 (and in other embodiments electromagnets 136 and 138) are operable by the controller 132 to act on materials in the sheet of paper 106 to pull the sheet 106 down against the wire mesh or felt belt 108. In other embodiments, segments of the electromagnet 130 above and below the sheet 106 are operated with opposing magnetic polarities to exert a force both from above and from below, in order to force water out of the paper suspension. In both embodiments, the techniques of the present disclosure operate to force more water out of the paper suspension, allowing a smaller size for the sheet formation section 102 or a drier sheet 106 leaving the section 102. The techniques of the disclosure also operate to form a tighter pulp web, reducing water retention and improving cohesion and tensile strength in the sheet 106.

The pulp of the sheet of paper 106 may also be aligned into a desired configuration by the action of the electromagnet 130. In embodiments using the electromagnets 136 and 138, the arrangement of fibers in the sheet may be further affected by applying magnetic fields of a first polarity with a first subset of electromagnets and a second polarity with a second subset of the electromagnets. These embodiments of the disclosure also operate to form a tighter pulp web, reducing water retention and improving cohesion and tensile strength in the sheet 106.

In still other embodiments, the electromagnets may be operated to draw the sheet of paper 106 being formed away from the wire mesh or grid 108, in order to reduce an imprint of the wire mesh 108 on the bottom side of the sheet 108.

In a further embodiment, the sensor 134 may comprise a plurality of sensors positioned across the width of the sheet of paper 106, corresponding to a plurality of electromagnets 130 positioned across the width of the sheet 106. In such an embodiment, the controller 132 receives a signal from each of the sensors 134 associated with a corresponding segment of the width of the sheet 106. The controller 132 then varies the magnetic field applied by the corresponding electromagnet 130 to the sheet 106 in response to the plurality of signals from the sensors 134 to transform a physical characteristic of the corresponding segment of the width of the sheet 106.

It may be advantageous to set forth definitions of certain words and phrases used throughout this patent document. The term "couple" and its derivatives refer to any direct or indirect communication between two or more elements, whether or not those elements are in physical contact with one another. The terms "over," "above," and the like denote relative positions of two or more elements in a particular orientation and do not require direct contact between the elements. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method of making paper, the method comprising:
   receiving one or more sensor measurements of at least one characteristic of a sheet of paper being formed;
   causing an electromagnet in a sheet formation section of a paper machine to apply a magnetic field to the sheet of paper prior to a dry line of the sheet, wherein the magnetic field acts on a material in the sheet of paper to alter the at least one characteristic of the sheet; and
   controlling the magnetic field generated by the electromagnet based on the one or more sensor measurements to control the at least one characteristic of the sheet.

2. The method of claim 1, wherein the magnetic field acts on the material in the sheet of paper to alter at least one of water content and fiber orientation.

3. The method of claim 1, wherein causing the electromagnet to apply the magnetic field comprises:
   causing a first electromagnet to apply a first magnetic field to a first side of the sheet of paper; and
   causing a second electromagnet to apply a second magnetic field to a second side of the sheet of paper.

4. The method of claim 1, wherein the magnetic field is a varying magnetic field.

5. The method of claim 1, further comprising introducing into the sheet formation section a paper slurry comprising the material.

6. The method of claim 1, further comprising altering the material in the sheet of paper to be reactive to the magnetic field.

7. The method of claim 1, wherein causing the electromagnet to apply the magnetic field to the sheet of paper comprises:
   causing multiple electromagnets to apply a plurality of magnetic fields at a corresponding plurality of locations on the sheet of paper.

8. A paper machine including a sheet formation section comprising:
   an apparatus configured to apply a magnetic field to a sheet of paper being formed prior to a dry line of the sheet such that the magnetic field acts on a material in the sheet of paper to alter at least one characteristic of the sheet; and
   a controller configured to receive one or more sensor measurements of the at least one characteristic of the sheet, the controller also configured to control the magnetic field generated by the apparatus based on the one or more sensor measurements to control the at least one characteristic of the sheet.

9. The paper machine of claim 8, wherein the magnetic field acts on the material in the sheet of paper to alter at least one of water content and fiber orientation.

10. The paper machine of claim 8, wherein the apparatus comprises:

a first device that is configured to apply a first magnetic field to a first side of the sheet of paper; and a second device that is configured to apply a second magnetic field to a second side of the sheet of paper.

11. The paper machine of claim 8, wherein the magnetic field is a varying magnetic field.

12. The paper machine of claim 8, further comprising a device that is configured to introduce into the sheet formation section a paper slurry comprising the material.

13. The paper machine of claim 8, further comprising a device that is configured to alter the material in the sheet of paper to be reactive to the magnetic field.

14. The paper machine of claim 8, wherein the apparatus is configured to apply a plurality of magnetic fields at a corresponding plurality of locations on the sheet of paper.

15. The paper machine of claim 8, further comprising:

a sensor in the sheet formation section of the paper machine, the sensor configured to generate the one or more sensor measurements.

16. The paper machine of claim 15, wherein the at least one characteristic is at least one of: streaking, rises, depressions, and smoothness.

17. The method of claim 1, wherein the magnetic field acts on a material in the sheet of paper to pull the sheet of paper against a wire mesh or grid.

18. An apparatus comprising:

a controller device configured to:

receive one or more sensor measurements of at least one characteristic of a sheet of paper being formed;

cause an electromagnet in a sheet formation section of a paper machine to apply a magnetic field to the sheet prior to a dry line of the sheet such that the magnetic field acts on a material in the sheet to alter the at least one characteristic of the sheet; and control the magnetic field generated by the electromagnet based on the one or more sensor measurements to control the at least one characteristic of the sheet.

19. The apparatus of claim 18, wherein the controller device is configured to control the magnetic field by controlling at least one of a strength, a polarity, and a duty cycle of the magnetic field generated by the electromagnet.

20. The apparatus of claim 18, wherein the controller device is configured to control the magnetic field in order to control at least one of streaking, rises, depressions, and smoothness of the sheet of paper.

21. The apparatus of claim 18, wherein the controller device is configured to control the magnetic field in order to move the sheet away from a wire mesh or grid and thereby reduce an imprint of the wire mesh or grid on the sheet.

22. The apparatus of claim 18, wherein the controller device is configured to cause multiple electromagnets to apply multiple magnetic fields with opposing magnetic polarities to the sheet in order to force water out of a paper suspension.

* * * * *